US005863032A

United States Patent [19]

Arias

[11] Patent Number: 5,863,032

[45] Date of Patent: Jan. 26, 1999

[54] PROTECTIVE COVER FOR STAPLE REMOVER

[76] Inventor: Arturo G. Arias, 16711 Collins Ave., #1106, Miami Beach, Fla. 33160

[21] Appl. No.: 876,977

[22] Filed: Jun. 16, 1997

Related U.S. Application Data

[63] Continuation of Ser. No. 684,990, Jul. 22, 1996, abandoned.

[51] Int. Cl.[6] ..... B25C 11/00

[52] U.S. Cl. ..... 267/145; 254/28

[58] Field of Search ..... 260/153, 136, 260/141; 254/28, 1

[56] References Cited

U.S. PATENT DOCUMENTS 4,139,187 2/1979 Hanusa ..... 267/145

4,776,567 10/1988 Strickland ..... 254/1

5,088,692 2/1992 Weiler ..... 254/28

*Primary Examiner*—Matthew C. Graham

*Attorney, Agent, or Firm*—Robert M. Downey, P.A.

[57] ABSTRACT

A boot for attachment on both of the opposite ends of a staple remover to cover the proximal end portions of the upper and lower opposing jaw members aft of the hinge point and/or the teeth on the distal end portions of the jaw members. The boot includes a resilient, cushioned base having an outer main face defining a pressure application surface and an opposite inner face structured to engage the proximal ends of the jaw members. A collar having an elastic memory extends from the base, in surrounding relation to the inner face, to define an open ended cavity sized and configured for snug fitted receipt of the proximal and/or distal end zones of the jaw members therein.

6 Claims, 2 Drawing Sheets

PROTECTIVE COVER FOR STAPLE REMOVER

This application is a continuation application of patent application Ser. No. 08/684,990 filed on Jul. 22, 1996, now abandoned.

BACKGROUND OF THE INVENTION

1. Field of the Invention

The present invention relates to a protective cover for attachment to a staple remover to cover either the hinged end zones of the opposing jaw members in order to further provide a comfortable means for exerting pressure on the proximal end of the staple remover or the distal teeth to protect the user from injury when the staple remover is not being used.

2. Description of the Related Art

Staple removers typically include a pair of opposing jaw members each including distal ends with inwardly directed opposing teeth and proximal end zones pivotally attached at a common hinge. Handle means are provided on each of the jaw members for squeezing the jaw members closed so that the opposing teeth converge towards each other.

When removing a staple that is deeply embedded within an object, wherein the crown of the staple is tight against the surface of the object, it is necessary to press the outer bearing surfaces of the teeth of the staple remover against the surface of the object prior to squeezing the jaws closed in order to assure that the teeth slide between the crown and the object's surface. In this instance, there are two separate forces being applied to the staple remover by the user's hands. Specifically, the user must exert a force against the proximal end of the staple remover, so that the outer bearing surfaces are pressed against the object's surface. Simultaneously, the user must apply a squeezing force on the opposite jaw members to close the opposing teeth.

The various staple removers known in the related art fail to provide a comfortable means on the proximal end for exerting a force thereon with one's hands or fingers. In fact, most staple removers expose the metal edges of the jaw members at the proximal end. While these edges are typically rounded, they still tend to cut into the skin on the fingers and palms when pressing the staple remover against an object to remove a tightly embedded staple therefrom. Furthermore, the user's skin can become pinched between the overlapping end zones of the jaw members which move relative to one another as the jaw members are squeezed closed.

Moreover, when staple removers are not in use, their jaws remain open, exposing the sharp pointed ends of the teeth. This presents a hazard to many users of such devices, especially when reaching blindly into a desk drawer cluttered with objects, wherein it is necessary to feel around and grasp various items to identify any particular one needed at that time. This typically results in punctured finger tips when a person's fingers are inadvertently pressed against the points of the staple remover teeth.

Accordingly, there exists a need in the related art for a protective cover device in the form of a boot adapted for fitted attachment on both the proximal end zone of virtually any staple remover of the type described above, wherein the boot includes a resilient, cushioned base which seats against the proximal end of the staple remover to provide a comfortable pressure application surface.

SUMMARY OF THE INVENTION

The present invention relates to a cover in the form of a boot adapted for attachment on both the proximal end zone and distal end zone of a staple remover to cover the end zones of the upper and lower opposing jaw members aft of the hinge point as well as the teeth on the opposite distal end zones of the jaw members. The boot includes a resilient, cushioned base having an outer main face defining a pressure application surface and an opposite inner face structured to engage the proximal and/or distal ends of the jaw members. A collar extends from the base, in surrounding relation to the inner face, to define an open ended cavity sized and configured for snug fitted receipt of the end zones of the jaw members therein. The collar is provided with an elastic memory to permit stretching thereof as the upper and lower jaw members are squeezed closed.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

A protective cover, generally indicated as 10, for attachment to either or both of the opposite ends of a staple remover 12 is shown throughout the several views of the drawings.

Figure 1:
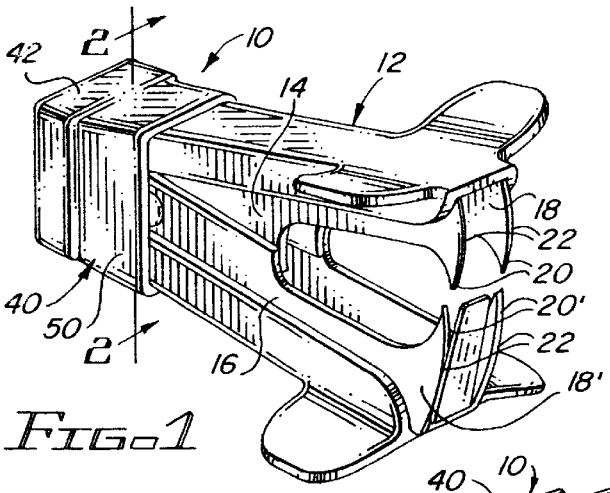
FIG. 1 is a front perspective view of a staple remover showing the protective cover fitted to a proximal end zone thereof.
Figure 4:
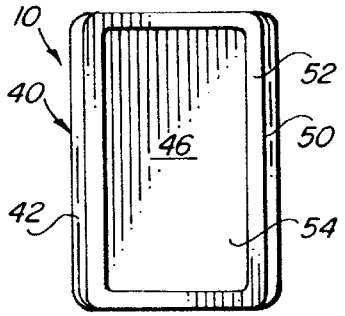
FIG. 4 is an end elevation of the protective cover, showing the inner face of the base and the collar surrounding the open ended cavity.
Figure 2:
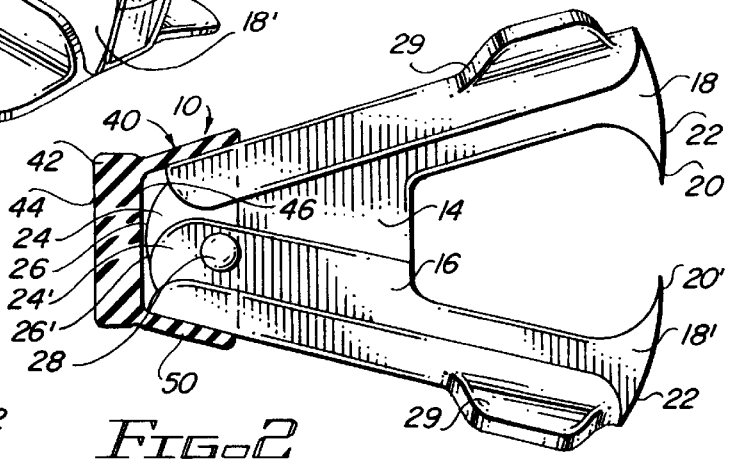
FIG. 2 is a side elevation, in partial section, wherein the section is taken along the line 2—2 of FIG. 1.
Figure 3:
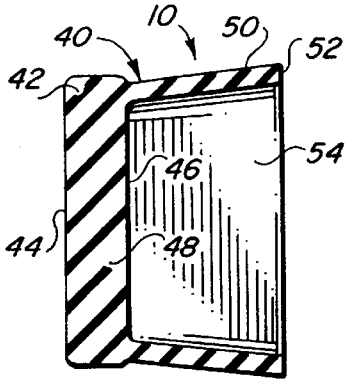
FIG. 3 is a side sectional view of the protective cover of the present invention.
Figure 5:
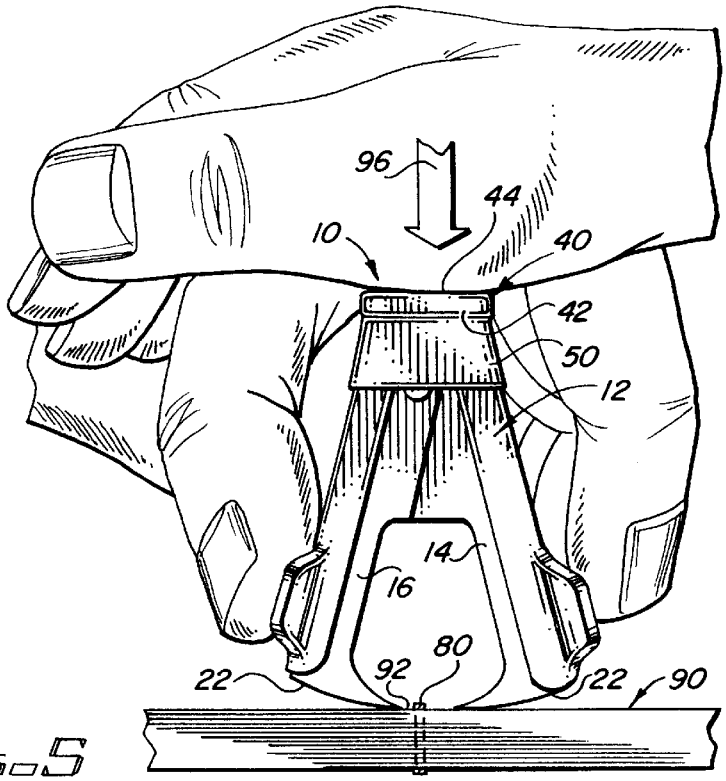
FIG. 5 is a side elevational view showing the protective cover in use on a staple remover when removing a staple from an object.

The protective cover 10 is adapted for attachment to virtually any staple remover device of the type shown in FIGS. 1, 2 and 5–7, wherein the staple remover device 12 includes a pair of opposing jaw members 14, 16, each including distal end zones 18, 18' with inwardly directed opposing teeth 20, 20' respectively. As seen in FIGS. 1, 2 and 5, the teeth 20, 20' of staple remover devices 12 of this type include an outer bearing surface 22 and pointed tips 23. The outer bearing surface 22 of each of the teeth is generally arcuate and adapted for sliding engagement with a surface 92 of an object 90 when removing a staple 80 therefrom.

The upper and lower jaw members 14, 16 further include proximal end zones 24, 24' respectively, each having a proximal edge 26, 26' aft of a common hinge 28. Handle means 29 are provided on the upper and lower jaw members to permit grasping and squeezing thereof so that the opposing jaw members 14, 16 are urged closed to cause the opposing teeth 20, 20' to converge towards one another on opposite sides of the crown of the staple 80.

The protective cover 10 of the present invention is comprised of a boot 40 structured for attachment in covering relation on the proximal end zones 24, 24' as well as the distal end zones 18, 18' of the jaw members 14, 16, as seen in FIGS. 1, 2, 5–7.

The boot 40 includes a generally rectangular base 42 having an outer main face 44 defining a pressure application surface and an opposite inner face 46 which abuts the proximal ends 26, 26' of the jaw members 14, 16. The base 44 is of a predetermined thickness and formed of a resilient, cushioning material, such as a rubber composition, to thereby define a resilient cushion means 48.

The boot 40 further includes a collar 50 defined by a continuous wall structure integrally formed about a periphery of the inner face 46 of the base 42, in surrounding relation to the inner face 46. The collar 50 extends away from the inner face 46 and terminates at a free edge 52 to define an open end communicating with an inner cavity 54. The collar 50 is specifically sized, shaped and configured for snug fitted attachment about the proximal end zones 24, 24' of the upper and lower jaw members 14, 16, respectively, so that the proximal end zones 24, 24' remain within the cavity 54, as seen in FIGS. 1, 2 and 5. The collar, being formed of a resilient material, is provided with an elastic memory to permit stretching thereof as the upper and lower jaw members of the staple removing device 12 are squeezed closed, causing the respective proximal end zones 24, 24' to move away from each other aft of the common hinge 28.

Figure 6:
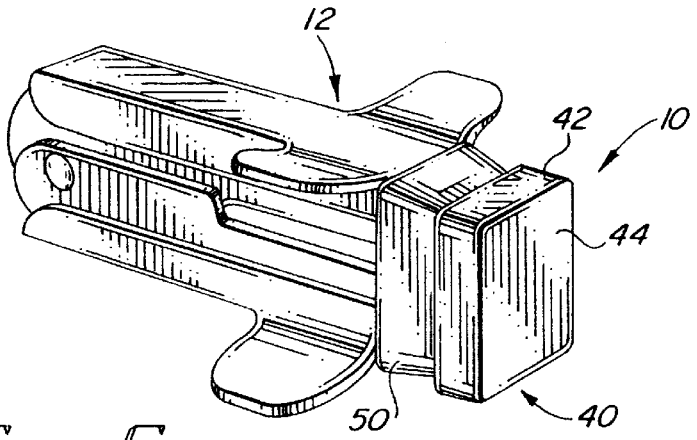
FIG. 6 is a front, side perspective view of the staple remover shown with the upper and lower jaw members closed and the protective cover the invention fitted to the distal end zones of the jaw members protectively covering the teeth.
Figure 7:
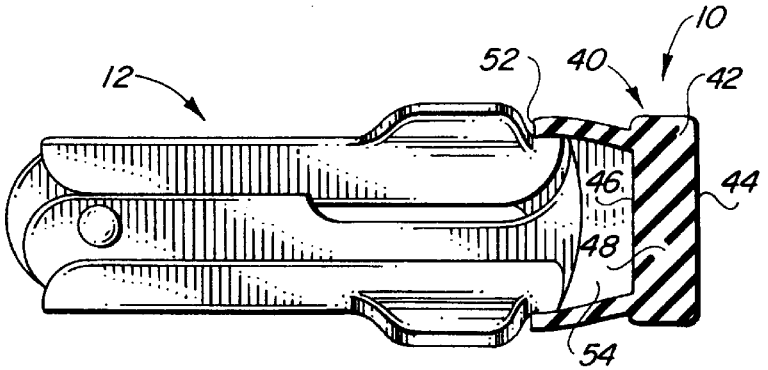
FIG. 7 is a side elevation, in partial section, showing the protective cover fitted over the distal ends of the upper and lower jaw members.

The collar is further adapted for receipt over the distal end zones 18, 18' of the jaw members to protectively cover the pointed tips 23 and outer bearing surfaces 22 of the teeth 20, 20', 22, 22'. To fit the cover 10 over the distal end zones 18, 18', as seen in FIGS. 6 and 7, the jaw members are squeezed and held closed while the collar 50 is slipped over the distal ends of the jaw members. Once in position, as shown in FIGS. 6 and 7, closing pressure on the jaw members is released. Pressure of the jaw members on the collar 50, as they are urged to open by an internal spring, helps to maintain the cover 10 on the distal end zones 18, 18'.

In a preferred embodiment, the base 42 and collar 50 are formed as an integral one piece unit of the same composition. It is preferable that the composition of which the entire boot 40 is formed of be a resilient, durable material such as a rubber or latex composition. While not shown in the drawings, the interior of the base 42 may be provided with a solid core material to provide more rigidity when pressing against the pressure application surface 44.

The pressure application surface 44 of the base 42 is specifically structured to permit pressure to be exerted thereon, as indicated by the arrow 96 in FIG. 5, to thereby transmit a force to the outer bearing surfaces 22 of the teeth 20, 20' urging the outer bearing surfaces 22 firmly against the surface 92 of the object 90. This helps to ensure that the teeth 20, 20' will pass under the crown of the staple 80, between the crown of the staple and the object 90, as the jaw members are squeezed closed.

While the instant invention has been shown and described in what is considered to be a preferred and practical embodiment thereof, it is recognized that departures may be made within the spirit and scope of the invention which is, therefore, not to be limited except as set forth within the following claims and under the doctrine of equivalents.

Now that the invention has been described,

What is claimed is:

1. A staple removing device comprising:

a pair of hinged, opposing jaws each including correspondingly positioned proximal end zones aft of a common hinge, and oppositely disposed distal end zones with teeth extending therefrom, said teeth having pointed tips and outer bearing surfaces;

a boot comprising:

a base having an outer main face defining a pressure application surface and an opposite inner face;

a collar extending from the base in surrounding relation to said inner face to define an open ended cavity;

resilient cushion means on said base for providing comfort when applying pressure to said pressure application surface;

said collar being structured and configured for snug fitted receipt of said proximal end zones of said jaw members so that said boot is attached to the staple removing device with said proximal end zones thereof disposed in captivated relation within said open ended cavity, so that pressure exerted on said pressure application surface of said base is transmitted to the outer bearing surfaces of the teeth and against the surface of the object; and said collar being further structured and configured for snug fitted receipt of said distal end zones of said jaw members with said jaw members in a closed position so that said boot remains removably attached thereto in covering relation to the pointed tips and outer bearing surfaces of the teeth.

2. An article as recited in claim 1 wherein said collar is defined by a continuous wall structure integrally formed about a periphery of said inner face of said base and extending away from said inner face to a free edge surrounding said open ended cavity.

3. An article as recited in claim 2 wherein said collar is provided with an elastic memory to permit stretching thereof as the upper and lower jaw members of the staple removing device are squeezed closed and urged open.

4. An article as recited in claim 3 wherein said boot is formed as an integral one piece unit.

5. An article as recited in claim 4 wherein said boot is formed of a rubber composition.

6. An article as recited in claim 1 wherein said base has a predetermined thickness which is greater than a thickness of said collar.

* * * * *